United States Patent [19]

Kuhnert

[11] 4,100,766

[45] Jul. 18, 1978

[54] FLAT KNITTING MACHINE HAVING FOUR OPPOSED NEEDLE BEDS

[75] Inventor: Gottfried Kuhnert, Aalen, Germany

[73] Assignee: Gottfried Kuhnert, Aalen, Germany
Rudolf Schieber KG, Postfach, Germany

[21] Appl. No.: 805,382

[22] Filed: Jun. 10, 1977

Related U.S. Application Data

[63] Continuation-in-part of Ser. No. 599,436, Jul. 28, 1975, abandoned.

[30] Foreign Application Priority Data

Jul. 29, 1974 [DE] Fed. Rep. of Germany ..... 2436450

[51] Int. Cl.[2] ..... D04B 7/04

[52] U.S. Cl. ..... 66/64; 66/62

[58] Field of Search ..... 66/60, 64, 62, 126, 66/70

[56] References Cited

U.S. PATENT DOCUMENTS

| | | | |
|---|---|---|---|
| 617,039 | 1/1899 | Nelson | 66/62 |
| 1,797,436 | 3/1931 | Miller | 66/63 |
| 3,668,896 | 6/1972 | Betts et al. | 66/176 X |
| 3,668,898 | 6/1972 | Betts et al. | 66/176 X |
| 3,668,901 | 6/1972 | Betts et al. | 66/176 |
| 3,695,063 | 10/1972 | Betts et al. | 66/176 |
| 3,796,068 | 3/1974 | Betts et al. | 66/176 |

FOREIGN PATENT DOCUMENTS

| | | | |
|---|---|---|---|
| 1,219 | 1/1900 | Austria | 66/64 |
| 20,559 | 1/1881 | Fed. Rep. of Germany | 66/64 |
| 137,460 | 2/1901 | Fed. Rep. of Germany | 66/64 |
| 1,530 of | 1912 | United Kingdom | 66/64 |
| 27,730 of | 1903 | United Kingdom | 66/64 |

*Primary Examiner*—Ronald Feldbaum
*Attorney, Agent, or Firm*—Sughrue, Rothwell, Mion, Zinn and Macpeak

[57] ABSTRACT

A flat knitting machine based on a flat Vee-bed arrangement has four opposed needle beds comprising front and back main needle beds and front and back auxiliary needle beds located above the main beds. A carriage traversible the length of the beds includes a cam assembly for imparting knitting and loop transferring motions to the needles in all the beds. By selective co-operation of the several beds flat and tubular knitted fabrics of any known design can be produced.

1 Claim, 8 Drawing Figures

V. H. B.
V. G.B.
5.

V. H. B.
V. G. B.
9.
10.

V. H. B.
V. G. B.
5.

H. G. B.
H. H. B.
6.

H. G. B.
H. H. B.
12.
11.

H. G. B.
H. H.B.
6.

5.
6.
3.

V. H. B.
V. G. B.
9.

V. H. B.
V. G. B.
17.

V. H. B
V. G. B.
18.

V. H. B.
V. G. B.
9.

H. G. B.
H. V. B.
10.

H. G. B.
H. H. B.
19.

H. G. B.
H. H. B.
20.

H. G. B.
H. H. B.
10.

5.
9.
10.

V. H. B.
V. G. B.
11.

V. H. B.
V. G. B.
21.
22.

V. H. B.
V. G. B.
11.

H. G. B.
H. H. B.
12.

H. G. B.
H. H. B.
24.
23.

H. G. B.
H. H. B.
3
12.

6.
11.
12.

V. H. B.
V. G. B.
13.

6
V. H. B.
V. G. B.

7.
V. H. B.
V. G. B.
14
14.

3
V. H. B.
V. G. B.

V. H. B.
V. G. B.
1
2.

V. H. B.
V. G. B.
(15.) 1.
1.

8.
H. G. B.
H. H. B.
16.
16.

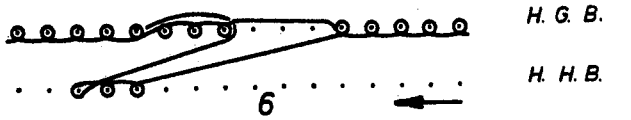
Fig.5w'
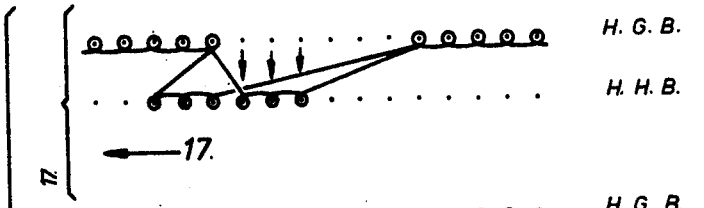
Fig.5x'
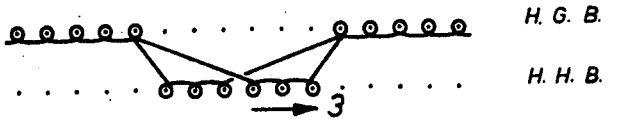
Fig.5y'
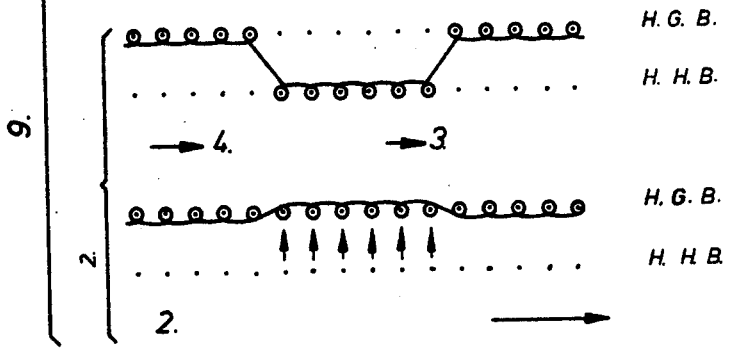
Fig.5z'
Fig.5a''
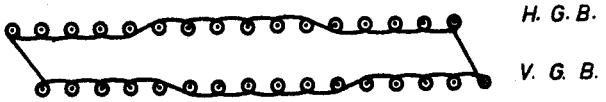
Fig.5b''

FLAT KNITTING MACHINE HAVING FOUR OPPOSED NEEDLE BEDS

CROSS-REFERENCE TO RELATED APPLICATION

The present application is a continuation-in-part of application Ser. No. 599,436, filed July 28, 1975 now abandon.

FIELD OF THE INVENTION

The present invention relates to a flat knitting machine having four opposed needle beds, comprising front and back main beds and front and back auxiliary beds located above the main beds.

DESCRIPTION OF THE PRIOR ART

A flat knitting machine of the type mentioned has already been described in French Pat. No. 1,073,501. Suitably equipped flat knitting machines having at least two opposed needle beds are capable of producing, in the form of a flat fabric, every known kind of knitting texture producible on flat machines. The flat portions of fabric knitted on such a machine must be later joined and linked together in a fairly laborious additional operation for the purpose of producing a finished article of knitwear.

SUMMARY OF THE INVENTION

It is an object of the present invention to provide a flat knitting machine which will permit every known type of knitting texture to be produced not only in the form of flat fabrics but also in the form of tubularly knitted fabrics, in other words knitted fabrics with double-sided or single-sided designs to be produced in the form of tubular knitting.

According to the invention this is accomplished in a flat knitting machine having two or more opposed knitting beds, in which each main bed and the auxiliary bed which faces it form a pair of co-operating needle beds in a flat Vee-bed knitting machine, and in which a cam assembly is provided on a carriage adapted to traverse the length of the needle beds for imparting knitting and loop transferring motions to the needles in the main beds as well as in the auxiliary beds.

The knitting of known kinds of knitting textures in the form of tubular fabric on the proposed flat knitting machine has the advantage that the work in the make-up department in the production of knitwear, such as the production of fancy stitch pullovers, is greatly reduced. Since in the case of a pullover the sleeves as well as the front and back portions of the body can be produced in the form of a fully fashioned tubular fabric, the completion of such a garmet merely calls for the joining together of these parts i.e. three in the case of a pullover.

The cam assembly preferably comprises two transfer cams, each operating in both directions of traverse, namely operating as a leading and a trailing transfer cam, respectively, and a double stitch cam system interposed between them.

A preferred embodiment of the invention is represented in the accompanying drawings and will be more particularly described hereinafter.

DESCRIPTION OF THE PREFERRED EMBODIMENT

Figure 1:
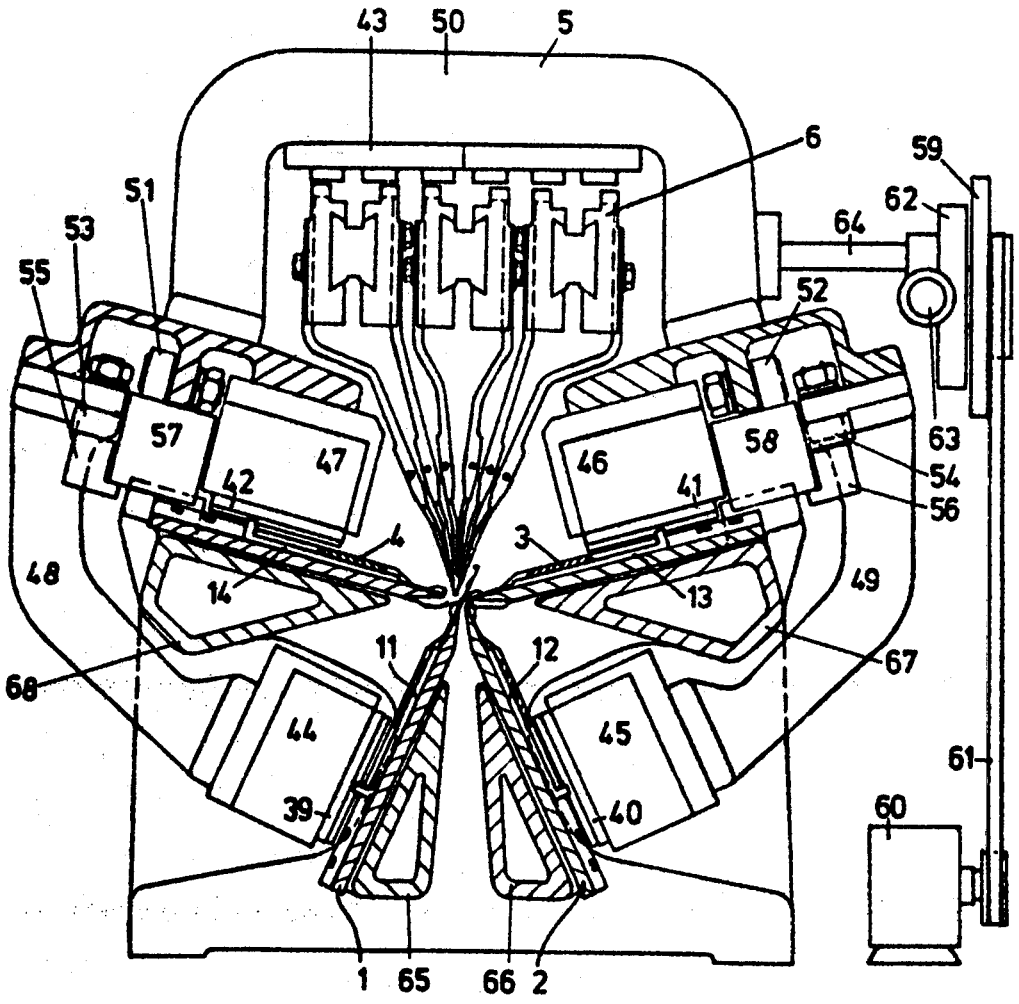
FIG. 1 is a cross-sectional view of a flat knitting machine according to the invention, showing the needle beds and the carriage.

Referring to FIG. 1 there is provided a flat knitting machine, of the kind also described as a twin Vee-bed flat kniting machine, which has needle beds disposed as shown in the drawings. The needle beds comprise a front main bed (F.M.B) 1, a back main bed (B.M.B) 2, a front auxiliary bed (F.A.B) 3 and a back auxiliary bed (B.A.B) 4. The several beds contain needles 11, 12, 13 and 14 respectively. The needle beds are movable on appropriately designed needle bed carriers.

In the particular embodiment illustrated in FIG. 1 the main beds 1 and 2 are disposed at an acute angle forming a Vee. The front auxiliary bed 3 is disposed above the back main bed 2 and the back auxiliary bed 4 is above the front main bed 1, each auxiliary bed being downwardly inclined towards the inside. The front main bed 1 and the front auxiliary bed 3 as well as the back main bed 2 and the back auxiliary bed 4 are likewise relatively inclined at an acute angle forming a Vee. A carriage 5 is adapted to traverse the length of the needle beds and contains an assembly of cams comprising a leading and trailing transfer cam working in both directions of carriage traverse and a double-stitch cam system located thereinbetween.

Yarn guides 6 are provided above the needle beds.

Figure 2:
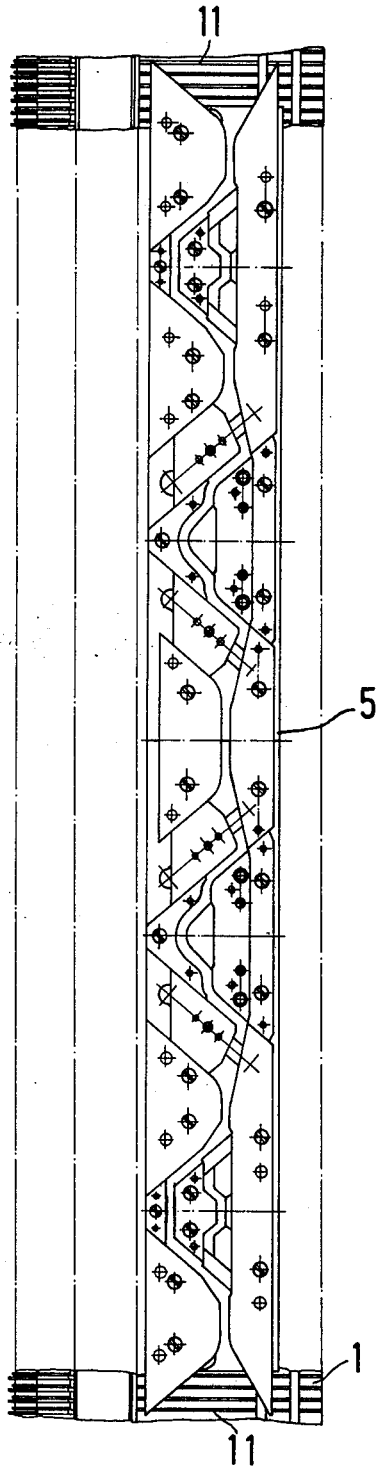
FIG. 2 is a side elevational view of part of the needle beds and of the cam system used in FIG. 1, the view being from the right in FIG. 1.

FIG. 2 illustrates part of the cam assembly on the carriage 5, namely that above the main bed 1. The construction of the other parts of the cam assembly associated with the main bed 2 and the auxiliary beds 3 and 4 is analogous to that of the cams shown in FIG. 2 for cooperation with the main bed 1.

The flat knitting machine of the invention may be regarded for purposes of description as being a combination of two ordinary flat machines. The four needle beds are so disposed that every conventional type of knitting texture producible on a flat knitting machine can be knitted in the form of a tubular fabric. The carriage 5, as shown in FIG. 1, is the carrier of locks 39, 40, 41, 42 and of thread guide drivers 43. It consists of carriage jaws 44, 45, 46 and 47 as well as carriers 48 and 49 for carriage jaws and of a high stirrup 50. Its ball and friction bearings 51, 52, 53, 54, 55 and 56 are disposed such that the carriage is capable of sliding back and forth on carriage guide rails 57, 58. It obtains movement from a chain drive 59. The chain drive consists of a motor 60 with a V-belt 61, a driving rocker arm (crank) 62, a crank guide bar 63 and a connecting lever 64 which couples the carriage with the drive.

On the outside the needle beds 1, 2, 3 and 4 have left and right screw-on surfaces which serve for the reception of two bearings and of the racking bar. The needle beds are screwed to the base body of the machine, the needle bed 1 to a tube (pipe) profile 65, the needle bed 2 to a tube profile 66, the needle bed 3 to a tube profile 67 and the needle bed 4 to a tube profile 68.

Figure 8:
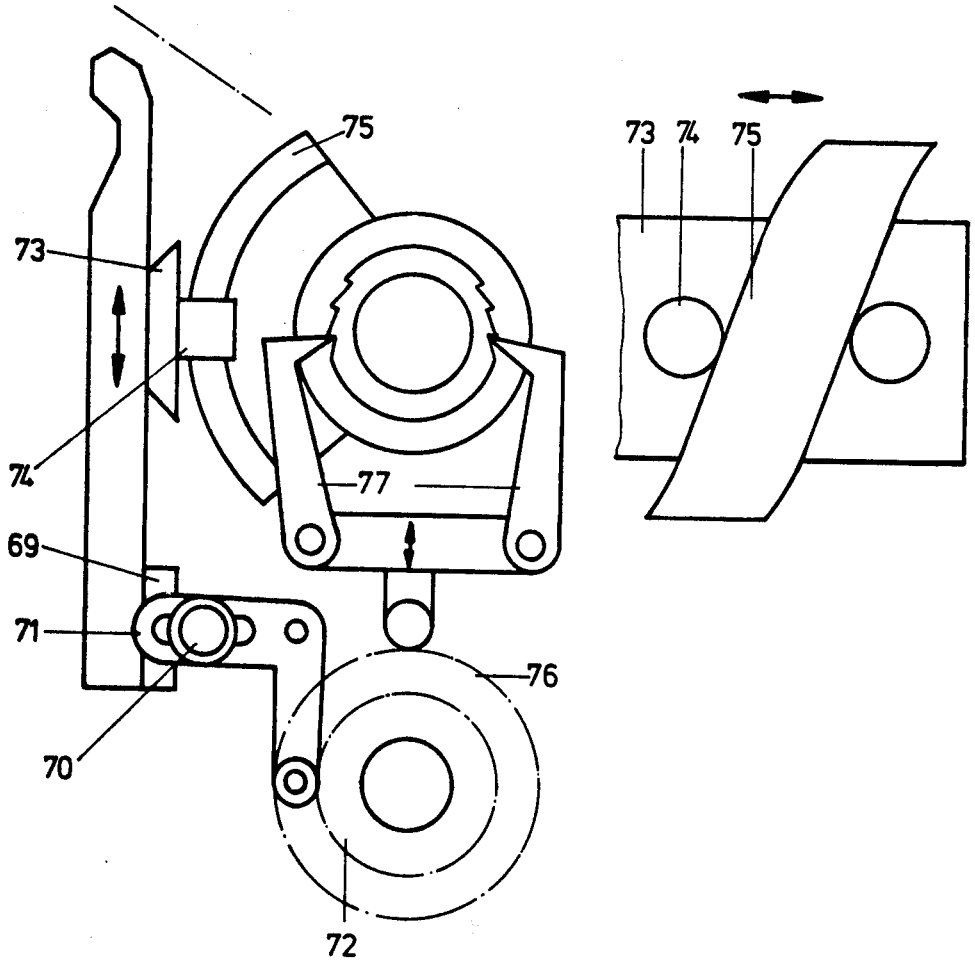
FIG. 8 is a side and elevational view of the means for moving the needle beds.

The attachment or mounting as well as the moving mechanism of the needle bed 3 which, just like also the needle bed 4 is laterally shiftable and in the direction of movement of the needles, is shown in FIG. 8. To the left and the right outside, there is always one bearing 69 attached on the reverse side of the needle bed in which always a guide bolt 70 is attached. This bolt projects into the elongated hole of a lever 71 and transmits the inforced eccenter motion of an eccentric 72 into an up and down movement of the needle bed. For the purpose of the lateral movement of the needle bed, there likewise are, left and right on the outside and on the reverse side of the needle bed, guide pieces 73 which are connected by way of rollers 74 with a shifting curve 75. The eccentric 76 moves the latches 77 up and down. The shifting curve 75 moves backward and forward depending on the position of the latch and thus it moves the needle bed to the left and to the right.

For the purpose of knitting a single bed tubular fabric it is best to arrange for cooperation of the front and back main beds 1 and 2, whereas for knitting single or double bed transfer stitch patterns by tubular knitting the main beds 1, 2 and the auxiliary beds 3, 4 can be made to cooperate. Moreover, for knitting rack rib designs the front auxiliary bed 3 can be used for racking the loops at the front and the back auxiliary bed 4 for racking the loops at the back.

When knitting a tubular fabric on the proposed flat knitting machine the diameter of the tube is advantageously variable by changing the working width by the activation or inactivation of the outermost needles 11, 12, 13, 14. In conjunction with electronically controlled widening and narrowing devices a fashioned tubular knitting can thus be readily produced.

The flat knitting machine of the invention also readily permits for instance tubular rib or tubular purl fabric to be produced. Likewise in conjunction with a, for instance, electronic needle selecting device and Jacquard, colour, Jacquard transfer stitch and Jacquard purl fabric designs can be produced in the form of tubular fabric.

It is also readily possible to change the pattern whilst knitting proceeds. For instance a knitting may be started in the form of a tubular 1 × 1 rib and then continued in the form of a tubular racked rib. As already mentioned the diameter of the tubular knitting is easily changed to the desired size by varying the working width on the machine. The performance of the flat knitting machine is equal to that of a conventional flat knitting machine with a double cam system.

The flat knitting machine of the invention also readily permits welts and parting courses to be knitted. The welts are the firm starting courses of a specific length of fabric, which cannot unrove, whereas the parting courses serve to separate two portions of fabric. If a parting course is provided between two lengths of fabric then each parting course must be followed by a welt. In the case of hand machines it is the invariable practice to insert a drawing off comb in the loops of the welt to keep the knitted fabric under downward tension. In fully automatic machines an existing fabric is run-on the needles and the bottom end of this fabric is attached to an automatic drawing off bar.

The knitting of a number of illustrative examples will be hereunder more particularly described.

Figure 3:
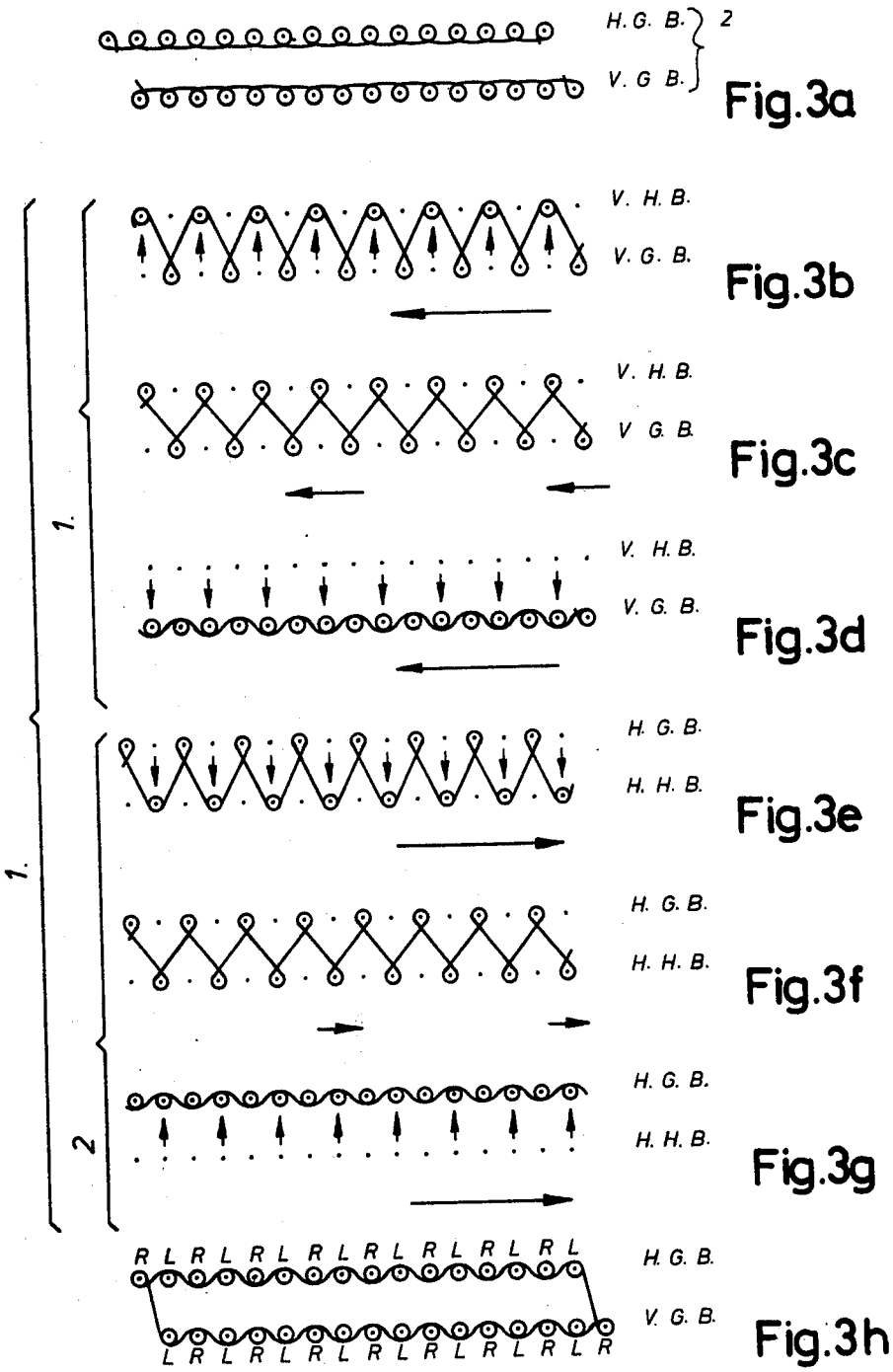
FIG. 3 is a diagrammatic representation of the method of operation for the production of a tubular rib knit fabric.

The process of knitting a rib knit tubular fabric will first be described with reference to FIG. 3. A fabric each has been run on the front main bed 1 and on the back main bed 2 as shown in FIG. 3*a*. Each of the needles 11 and 12 therefore carries a loop. The carriage 5 is assumed to be at the right hand end, the back auxiliary needle bed 4 being withdrawn as in FIG. 1.

Figure 6:
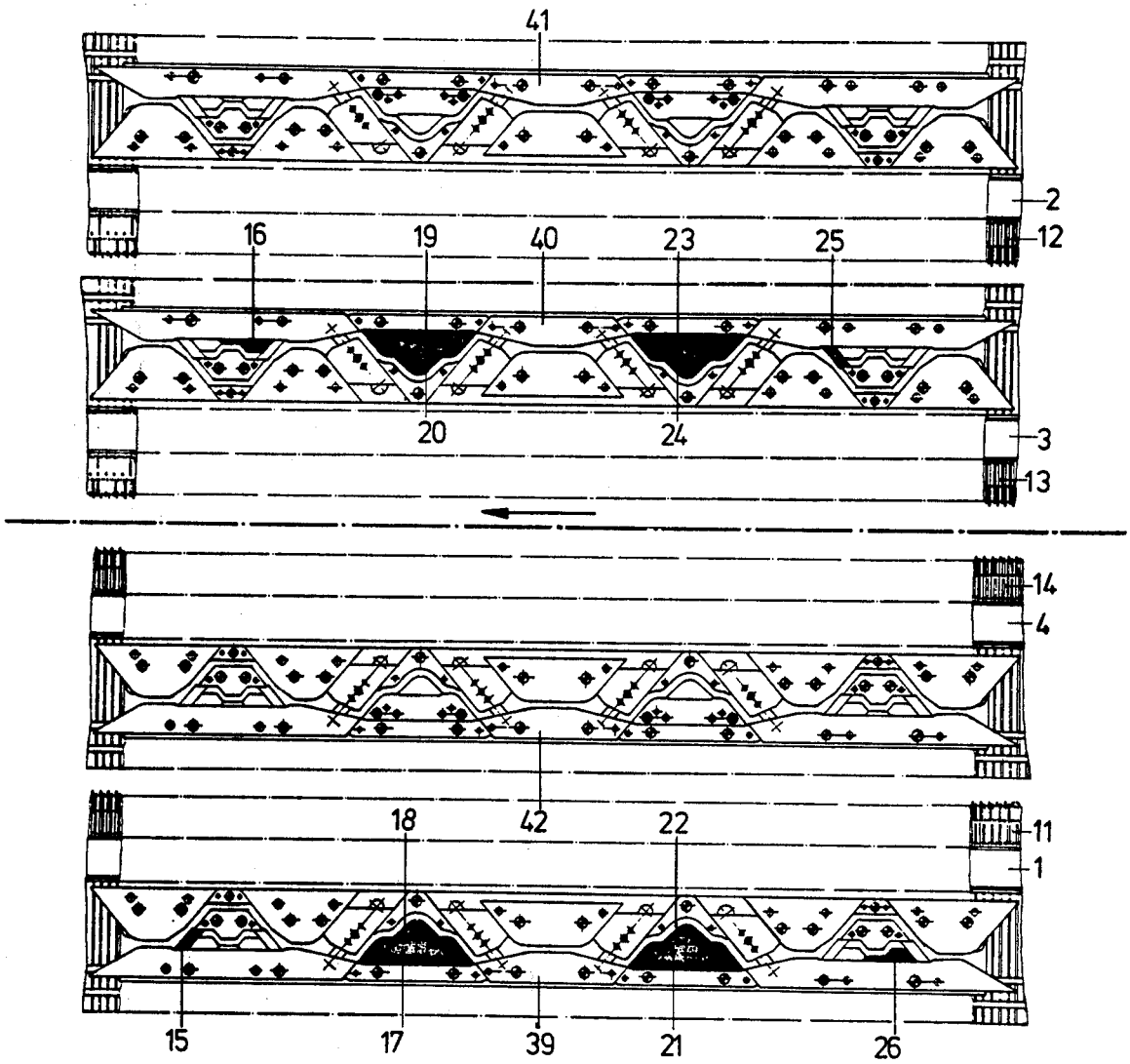
FIG. 6 is an elevational view of all needle beds and of the cam system with certain cam parts being in action.

The carriage 5 with the locks 39, 40, 41 and 42 is now moved to the left. At the same time, the loops of the 1st, 3rd, 5th . . . needle 11 of the forward basic bed 1 are leadingly tranferred to the 1st, 3rd, 5th . . . needle 13 of the forward auxiliary bed 3, as shown in FIG. 3*b*. In FIG. 6, the cam parts are stressed particularly which are operative in the process described here. First of all, the transmitting part 15 as well as the takeover part 16 are operative. After that, there follow two knitting rows as shown in FIG. 3*c*. For this, the knitting cams 17, 18, 19, 20 as well as 21, 22, and 23, 24 are to be made operative. Then the loops are transferred from the needle 13 of the forward auxiliary bed 3 to the empty needles 11 of the forward base bed 1, as shown in FIG. 3*d*. For this purpose, the transmitting part 25 and the takeover part 26 are needed. Now the carriage 5 stands on the left. The front auxiliary bed 3 is pulled back and the rear auxiliary bed 4 is moved into its base position.

Figure 7:
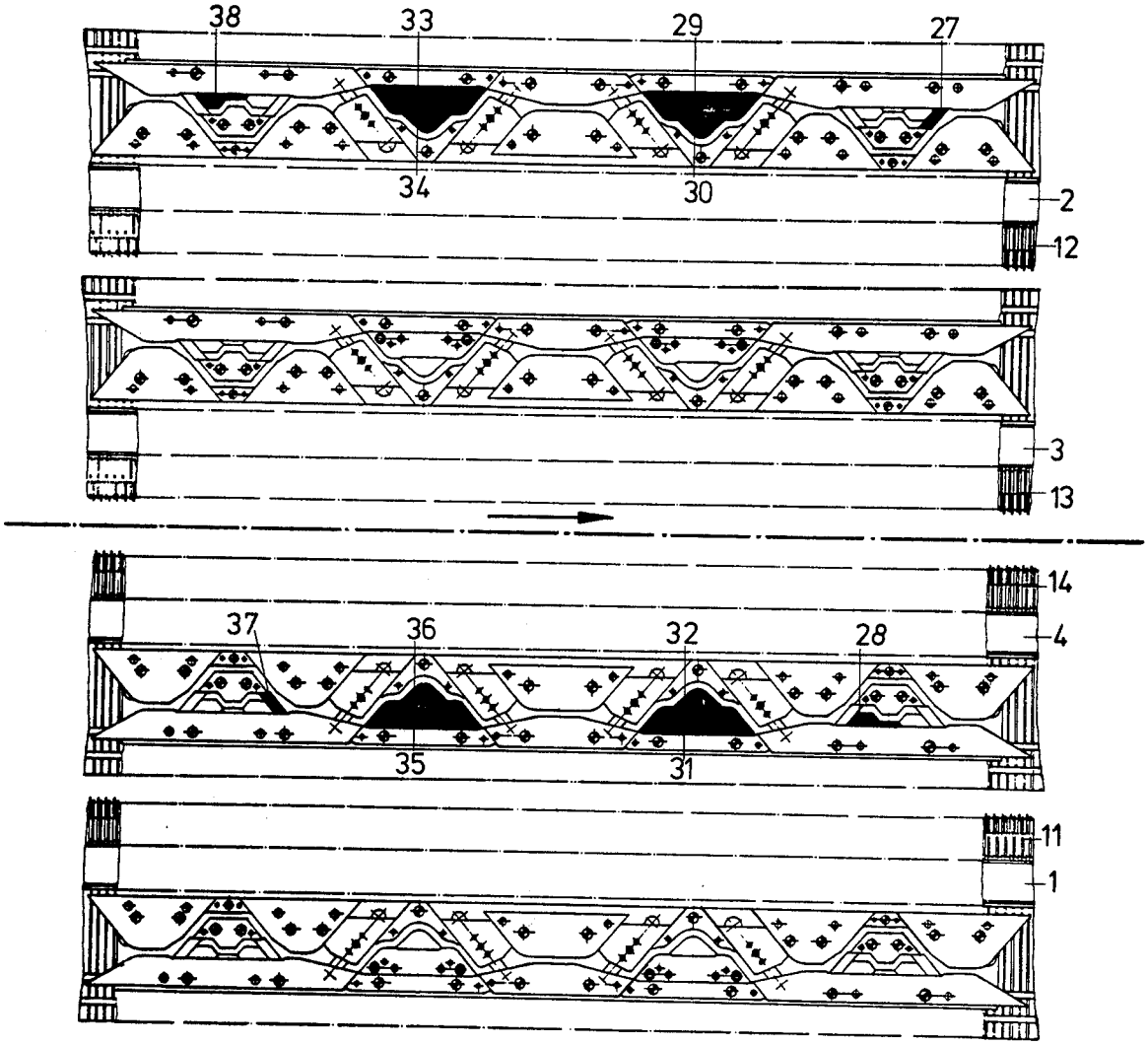
FIG. 7 is a view similar to the view of FIG. 6 with other cam parts being in action.

Now the carriage 5 is moved from left to right. In FIG. 7, the cam parts which, in this case, are operative (active), are stressed particularly. At the same time, the loops of the 2nd, 4th, 6th . . . needle 12 of the rearward basic bed 2 are leadingly transmitted to the 2nd, 4th, 6th . . . needle 14 of the rearward auxiliary bed 4, as shown in FIG. 3*e*. In order to achieve this, the transmitting part 27 and the takeover part 28 must be activated. Now, as indicated in FIG. 3*f*, two knitting rows are knit. The knitting cams 29, 30 and 31, 32 as well as 33, 34 and 35, 36 are operative. For this purpose, the loops are transmitted trailingly from the needles 14 of the rearward auxiliary bed 4 to the needles 12 of the rearward basic bed 2, which is indicated in FIG. 3*g* and which is achieved by means of the transmitting part 37 and the takeover part 38. FIG. 3*h* shows the state in which a complete carriage row is completed, that is to say two R/R(knit) rounds of hose are knit. The cam switchings take place in a known manner through bolt control (Riegelsteuerung) always in the case of the preceding reversal of the carriage.

Figures 4, 4A, 4B, 4C, 4D, 4E, 4F, 4G, 4H:
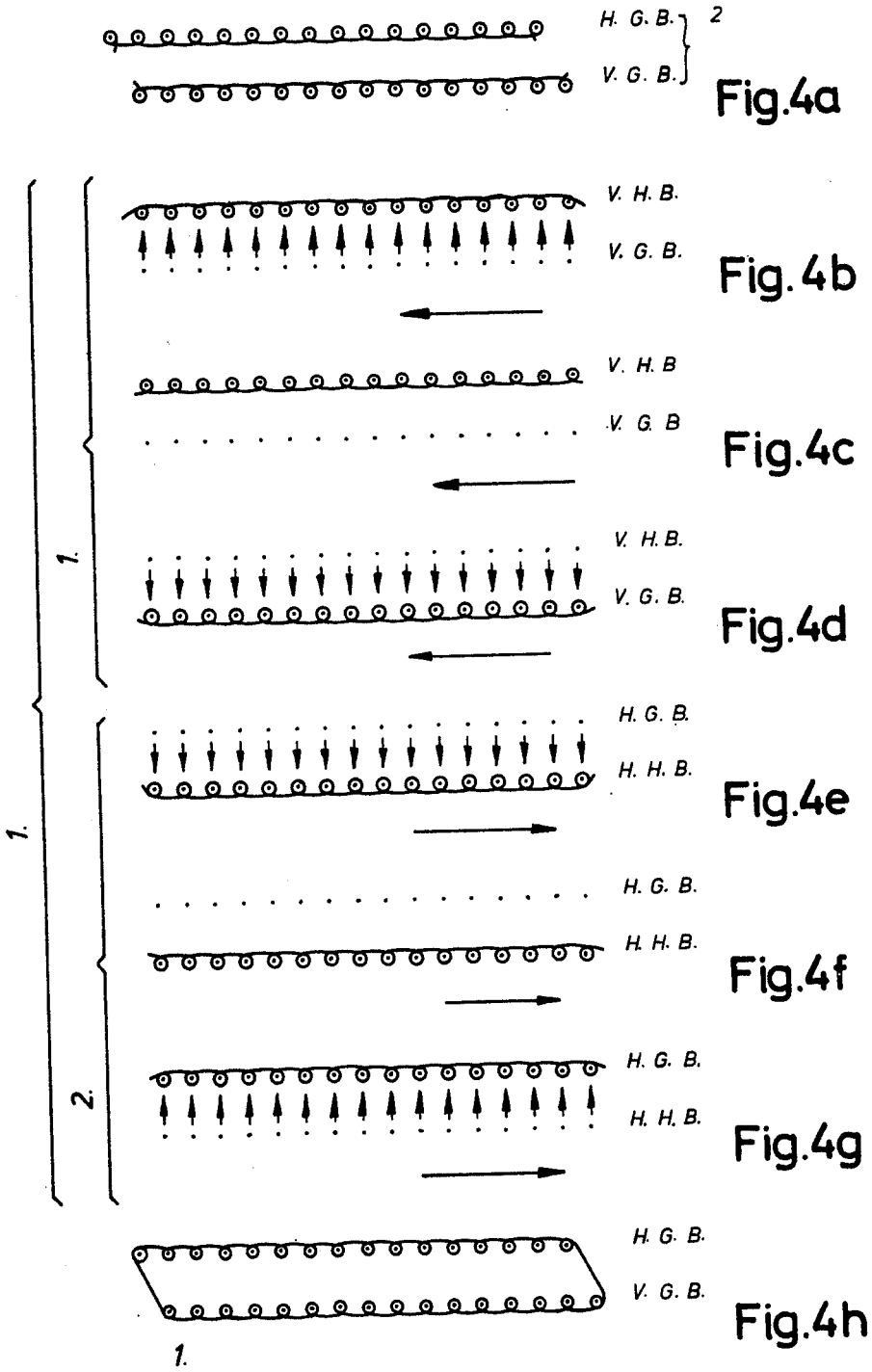
FIG. 4 is a diagrammatic representation of the method of operation for the production of a purl knit tubular fabric.

Referring to FIG. 4 the method of operation will now be described for the knitting of a tubular purl fabric. In FIG. 4*a* a fabric has been run on the front main bed 1 and on the back main bed 2. Each needle 11 and 12 carries a loop. Let it be assumed that the carriage 5 is at the right hand end. The back auxiliary bed 4 is withdrawn, as in FIG. 1.

The carriage 5 is now first traversed to the left. As shown in FIG. 4*b* this causes the loops 11 on the front main bed 1 to be transferred by the leading cam to the needles 13 of the front auxiliary bed 3. Then, as shown in FIG. 4*c*, a course of stitches is knitted using the leading or trailing stitch cam on the carriage 5 and the loops on the needles 13 of the front auxiliary bed 3 are retransferred to the needles 11 on the front main bed 1, as shown in FIG. 4*d*.

The carriage 5 is now on the left. The front auxiliary bed 3 is withdrawn and the back auxiliary bed 4 is brought forward into operative position. The carriage 5 is then traversed from left to right. The loops are thus now transferred by the leading cam from the needles 12 of the back main bed 2 to the needles 14 of the back auxiliary bed 4, as indicated in FIG. 4*e*. According to FIG. 4*f* another course of stitches is knitted with the leading or trailing stitch cam on the carriage 5. The loops are then re-transferred from the needles 14 of the back auxiliary bed 4 to the needles 12 of the back main bed 2, as will be understood from FIG. 4*g*. The carriage is now on the right and a complete circular course has been knitted, the purl loops, as shown in FIG. 4*h*, being visible on the outside.

Figures 4I, 4K, 4L:
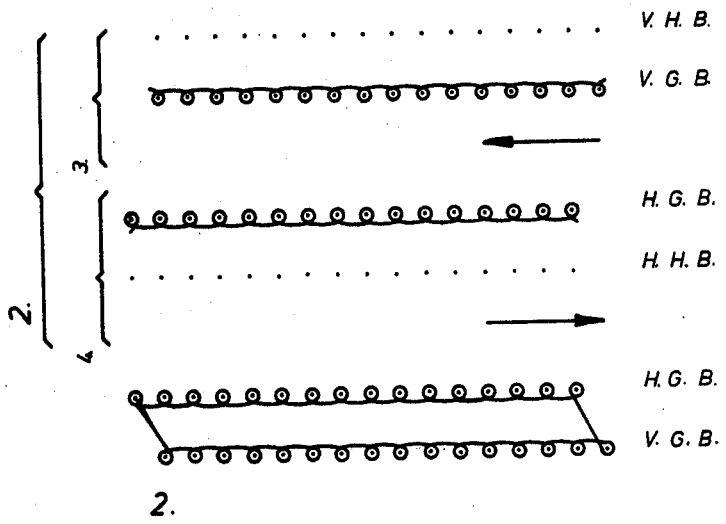

To prepare for the next traverse of the carriage the back auxiliary bed 4 is now withdrawn and the front auxiliary bed 3 moved into operative position. The carriage then moves from right to left and knits a course on the front main bed 1 using the leading or trailing stitch cam on the carriage 5 as shown in FIG. 4*i*. The carriage 5 thus changes over to the left.

The next stop is the withdrawal of the front auxiliary bed 3, whereas the back auxiliary bed is brought forward, the carriage 5 then moving back to the right. As shown in FIG. 4*k* the leading and trailing stitch cam knits a course on the back main bed 2. The carriage 5 is therefore again on the right and the second circular course has been completed, rib loops being visible on the outside, as in FIG. 4*l*. The continuous change-over between plain and purl knitted courses results in the production of a tubular purl fabric.

Figure 5:
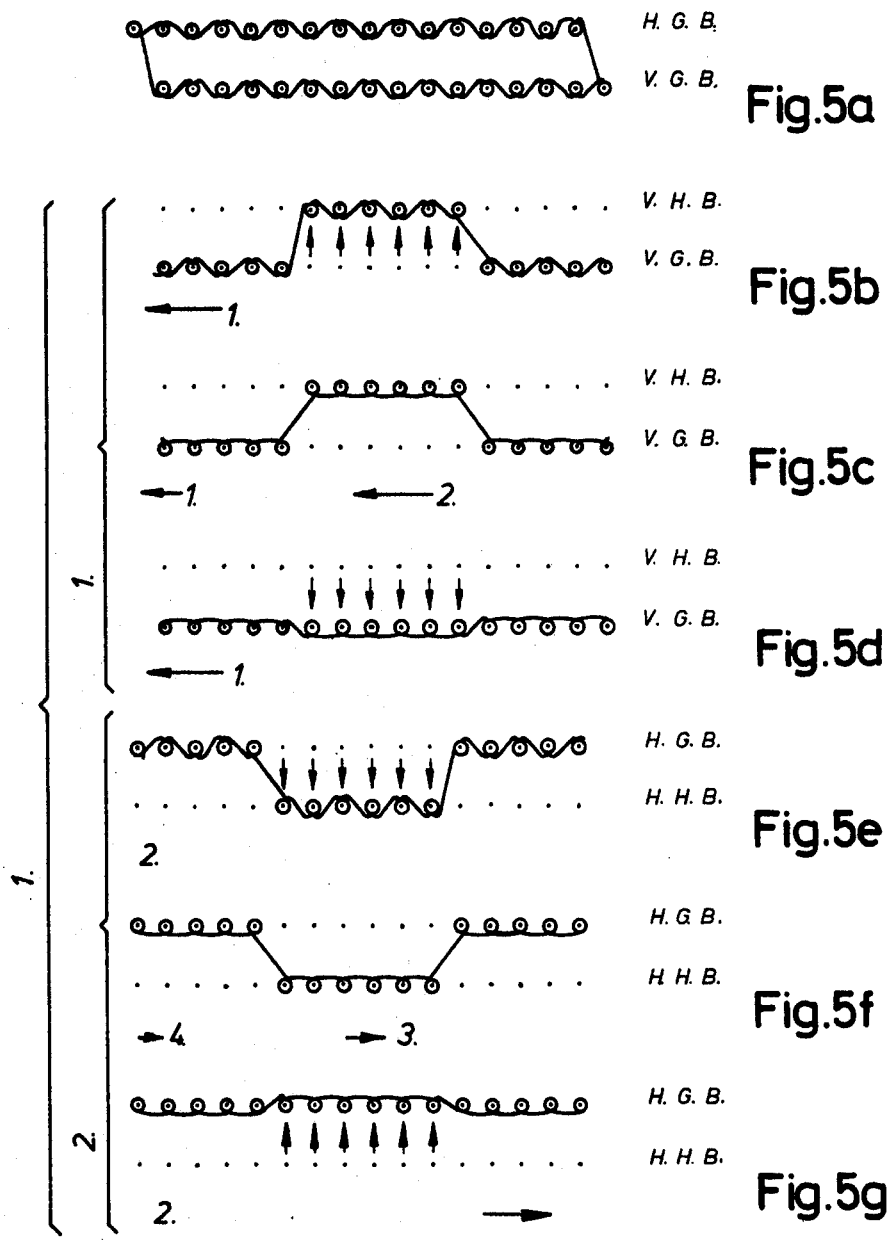
FIG. 5 is a diagrammatic representation of the method of operation for the production of a fancy design in a tubular fabric.

FIG. 5 exemplifies the procedure when knitting a tubular rack rib design. Before knitting begins, a tubular 1 × 1 rib knit welt has been produced, as already described with reference to FIG. 3.

Figures 5H, 5I, 5K, 5L, 5M, 5N:
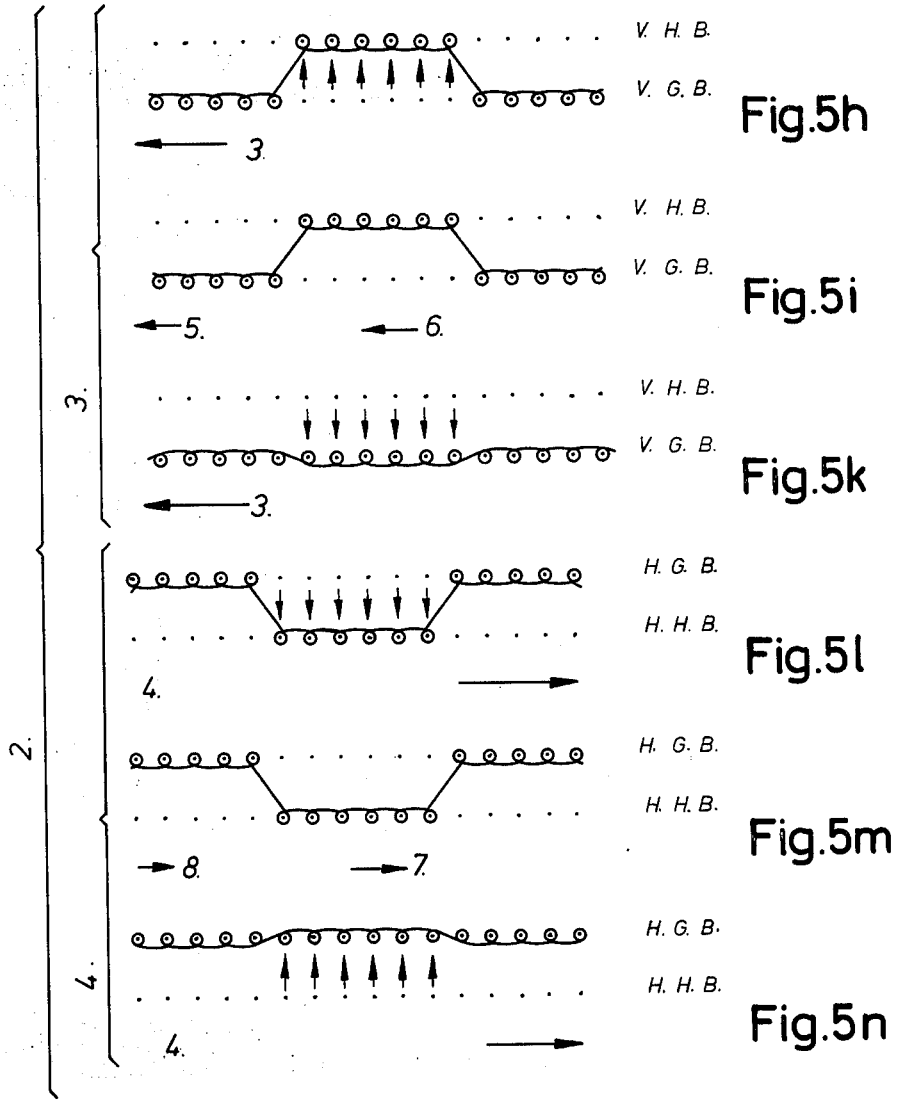
Figures 5O, 5P, 5Q, 5R, 5S, 5T:
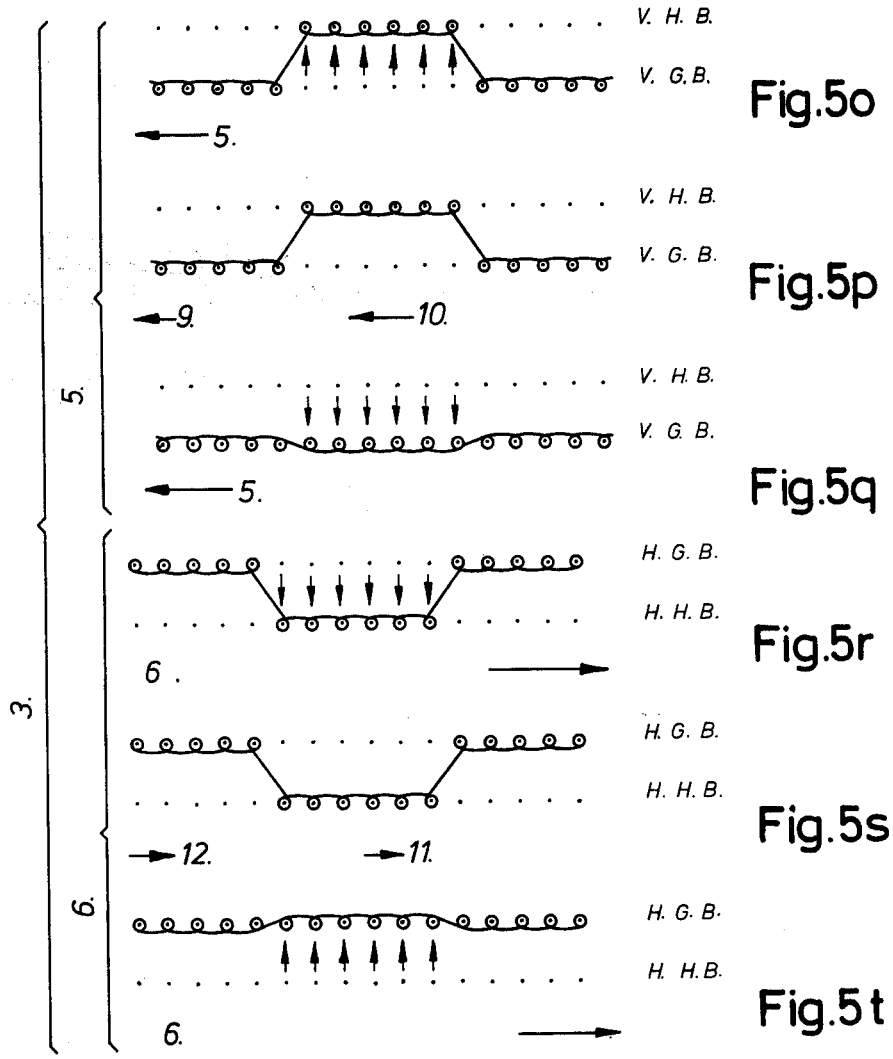
Figures 5U, 5V, 5W, 5X, 5Y, 5Z:
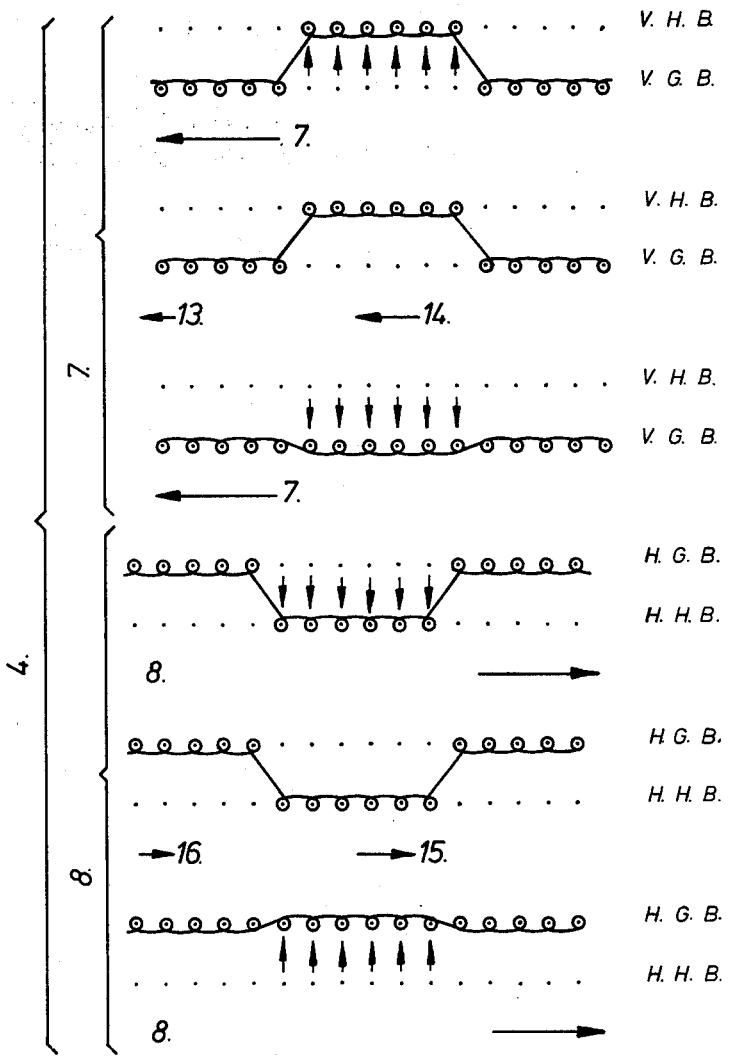
Figures 5A, 5B, 5C, 5D, 5E, 5F, 5G, 5H:
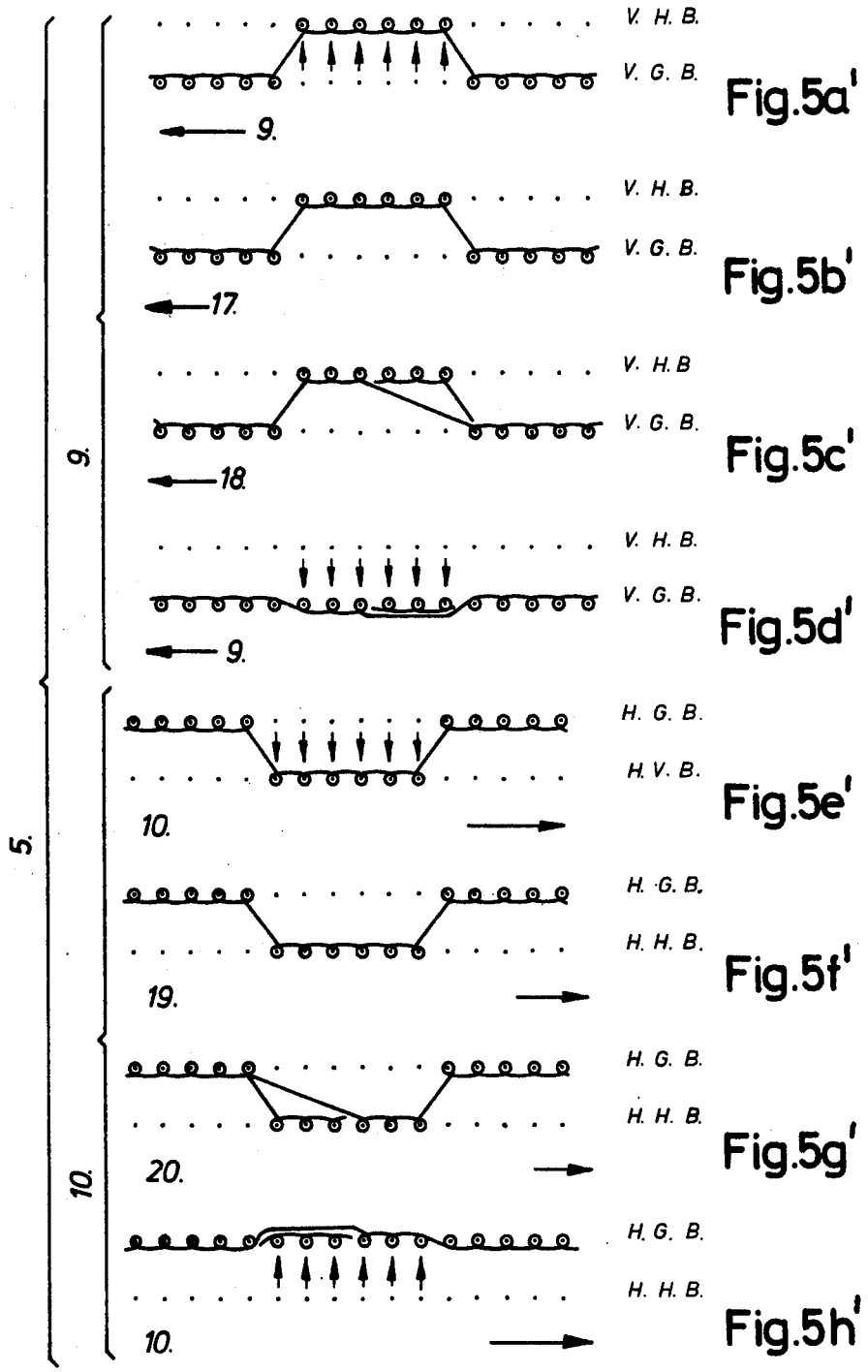
Figures 5I, 5K, 5L, 5M, 5N, 5O:
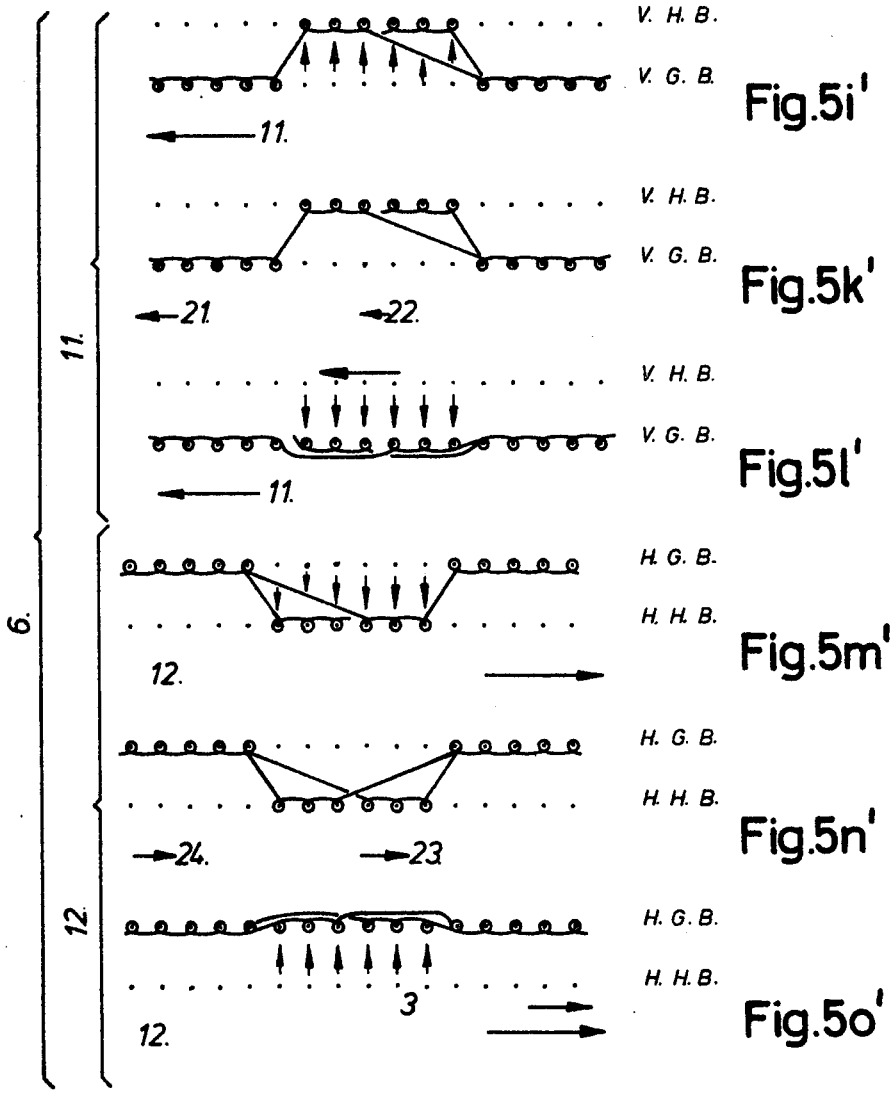
Figures 5P, 5Q, 5R, 5S, 5T, 5U, 5V:
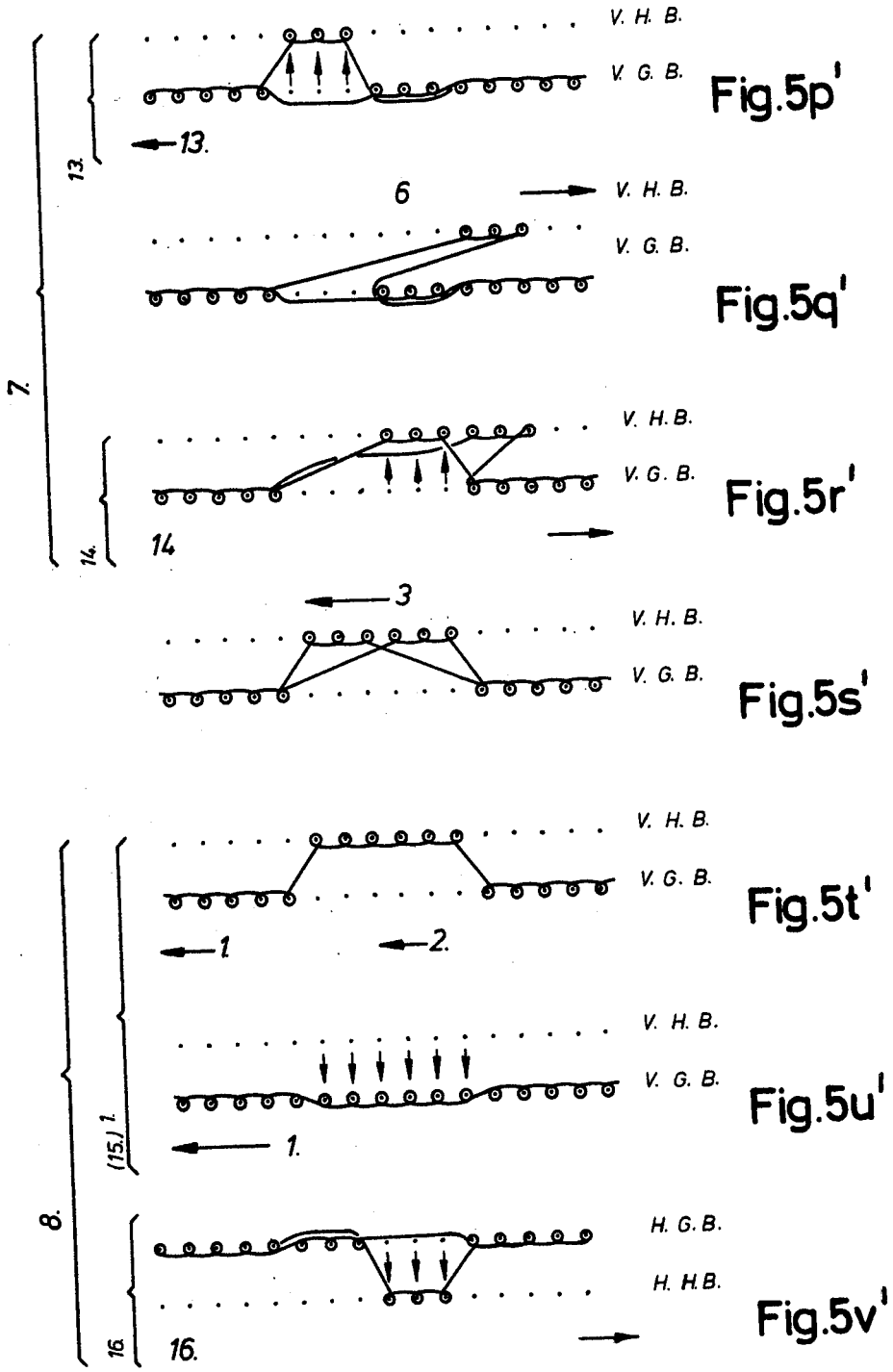

Purl and plain stitch loops hang on the needles 11 and 12 of the front main bed 1 and the back main bed 2 respectively, as indicated in FIG. 5*a* as well as in 3*h*. The carriage is on the right, the back auxiliary bed 4, as illustrated in FIG. 1 is withdrawn.

The first step is the traverse of the carriage 5 to the left. The loops of selected needles 11 of the front main bed 1, as shown in FIG. 5*b*, are transferred by the leading transfer cam to the needles 13 of the front auxiliary bed. The leading and the trailing stitch cams on the carriage 5 each knit a course as indicated in FIG. 5*c* and the trailing transfer cam transfers the loops on the front auxiliary bed 3 to the empty needles 11 of the front main bed 1, as indicated in FIG. 5*d*.

The carriage 5 is now on the left, the front auxiliary bed 3 is withdrawn and the back auxiliary bed 4 is brought into operative position. The carriage 5 is then moved left to right, the leading cam transferring the selected loops from the back main bed 2 to the needles 14 of the back auxiliary bed 4, as indicated in FIG. 5*e*. The leading and the trailing stitch cams on the carriage 5 knit 2 courses, as in FIG. 5*f*, whereas the trailing transfer cam, as shown in FIG. 5*g* transfers the loops from the back auxiliary bed 4 to the needles 12 of the back main bed 2. This carriage cycle is repeated three times, as illustrated in FIGS. 5*h* to 5*z*.

The carriage is now on the right, the back auxiliary bed 4 is withdrawn and the front auxiliary bed 3 is brought into operative position. The carriage moves to the left. The loops of the selected needles 11, as shown in FIG. 5*a*, are transferred by the leading cam from the front main bed 1 to the front auxiliary bed 3. FIGS. 5*b'* and 5*c'* show the run of the yarn for the leading and the trailing stitch cam operating selected stitch cam needles. Moreover, the loops on the front auxiliary bed 3 are re-transferred by the trailing transfer cam to the empty needles 11 of the front main bed 1, as shown in FIG. 5*d'*.

The carriage is now again on the left, the front auxiliary bed 3 is withdrawn and the back auxiliary bed 4 advanced into working position. The carriage 5 then traverses from left to right, and as shown in FIG. 5*e'* the loops on the selected needles 12 of the back main bed 2 are transferred to the needles 14 of the back auxiliary bed 4. According to FIG. 5*f'* a course of stitches is then knitted with the leading stitch cam and as shown in FIG. 5*g'* another course is knitted with the trailing stitch cam. When this has been done the loops on the back auxiliary bed 4 are transferred by the trailing transfer cam to the empty needles 12 of the back main 2 as shown in FIG. 5*h'*.

The carriage is now again on the right, the back auxiliary bed 4 is withdrawn and the front auxiliary bed 3 is brought forward into operating position. The carriage then returns to the left. As illustrated in FIG. 5*i'* the loops on the selected needles 11 of the front main bed are thus transferred by the leading cam to the needles 13 of the front auxiliary bed 3. At the same time, as indicated in FIG. 5*k'*, two courses are knitted and the trailing transfer cam causes the loops on the front auxiliary bed 3 to be transferred to the needles 11 of the front main bed 1, cf. FIG. 5*l'*.

The carriage 5 is now again on the left. During the reversal of the carriage the front auxiliary bed 3 is racked three needle spaces to the left. The front auxiliary bed 3 is then withdrawn and the back auxiliary bed 4 is brought forward, the carriage 5 starting its traverse to the right. The leading transfer cam causes the loops on the selected needles 12 of the back main bed 2 to be transferred to the needles 14 of the back auxiliary bed 4, as indicated in FIG. 5*m'*. Moreover, as illustrated in FIG. 5*n'* the leading and the trailing stitch cams knit two courses and the loops on the back auxiliary bed 4 are re-transferred as shown in FIG. 5*o'*, to the needles 12 of the back main bed 2.

The carriage is again on the right and the back auxiliary bed 4 is racked three needle spaces to the right as the carriage reverses. The back auxiliary bed 4 is withdrawn and the front auxiliary bed 3 is brought forward into working position. The carriage 5 then moves to the left. Either the leading or trailing transfer cam causes the loops on the selected needles 11 of the front main bed 1 to be transferred to the needles 13 of the front auxiliary bed 3, as shown in FIG. 5*p'*.

The carriage 5 is again on the left and the front auxiliary bed 3, as indicated in FIG. 5*q'*, is racked six needle spaces to the right during the reversal of the carriage at this end. The carriage returns to the right and again selected loops are transferred from the front main bed 1 to needles 13 of the front auxiliary bed 3 by the leading or trailing transfer cam, as shown in FIG. 5*r'*.

The carriage is once more on the right and, during its motion reversal, the front auxiliary bed 3, as indicated in FIG. 5*s'*, is racked three needle spaces to the left. During the following traverse of the carriage 5 to the left the leading or trailing stitch cam knits two courses according to FIG. 5*t'* and the loops of the front auxiliary bed 3, as shown in FIG. 5*u*′, are transferred to the empty needles 11 of the front main bed 1.

The carriage 5 thus returns to the left. During carriage reversal the front auxiliary bed 3 is withdrawn and the back auxiliary bed 4 is returned into operating position. The carriage 5 returns to the left. As indicated in FIG. 5*v*′, the selected loops on the back main bed 2 are transferred by the leading or trailing transfer cam to needles 14 of the back auxiliary bed 4.

The carriage 5 is again on the right and the back auxiliary bed 4, as shown in FIG. 5*w*′, is racked six needle spaces to the left. The carriage 5 returns to the left and the leading or trailing transfer cam again transfers selected loops from the back main bed 2 to needles 14 of the back auxiliary bed 4, as indicated in FIG. 5*x*′.

The carriage thus again arrives at the left hand end and during motion reversal the back auxiliary bed 4 is racked three needle spaces to the right, as indicated in FIG. 5*y*′. As the carriage 5 now again traverses to the right the leading and the trailing stitch cams, as indicated in FIG. 5*z*′, knit two courses and according to FIG. 5*a*″ the loops on the back auxiliary bed 5 are transferred by the trailing transfer cam to needles 12 of the back main bed 2. FIG. 5*b*″ finally shows the run of the yarn after a rack rib pattern repeat has been knitted at front and back. After completion the tubular knitting must be turned inside out to bring the rack rib design to the outside where it can be seen.

What is claimed is:

1. A flat knitting machine comprised of two flat V-bed knitting machines each having two opposed needle beds alternately arranged to provide front and back main beds and front and back auxiliary beds located above the main beds, wherein each of said beds are the same length each main bed and the auxiliary bed which faces it from a pair of cooperating needle beds, and single carriage means arranged to transverse the entire length of all the needle beds and including cam means for imparting knitting and loop transferring motions to the needles on both the main beds and both the auxiliary beds, said cam means comprising two transfer cams operable in both directions of traverse as a leading and trailing transfer cam and a double stitch cam system interposed between them.

* * * * *

UNITED STATES PATENT AND TRADEMARK OFFICE

CERTIFICATE OF CORRECTION

PATENT NO. : 4,100,766

DATED : July 18, 1978

INVENTOR(S) : Gottfried KUHNERT

It is certified that error appears in the above-identified patent and that said Letters Patent are hereby corrected as shown below:

IN THE HEADING:

Assignee, delete "Gottfried Kuhnert and Rudolf Schieber KG and insert -- UNIVERSAL MASCHINENFABRIK Dr. RUDOLF SCHIEBER KG --.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*